US005617753A

United States Patent [19]

Glissman et al.

[11] Patent Number: 5,617,753

[45] Date of Patent: Apr. 8, 1997

[54] LOW FORCE AUTO-OPEN TOOLING FOR TUBE BENDING MACHINE

[75] Inventors: Thomas W. Glissman, Avon; Ajay K. Bhandari, Westlake, both of Ohio

[73] Assignee: Pines Manufacturing, Westlake, Ohio

[21] Appl. No.: 540,545

[22] Filed: Oct. 6, 1995

[51] Int. Cl.[6] ..... B21B 37/08; B21D 7/04; B21D 9/05

[52] U.S. Cl. ..... 72/149; 72/158; 72/21.3

[58] Field of Search ..... 72/149, 369, 150, 72/151, 157, 158, 20.2, 21.3, 14.3

[56] References Cited

U.S. PATENT DOCUMENTS 2,911,031 11/1959 Yurka, Jr. .
4,178,788 12/1979 Zollweg et al. .
4,537,053 8/1985 Schwarze .
4,788,845 12/1988 Schwarze .

*Primary Examiner*—Lowell A. Larson
*Assistant Examiner*—Rodney Butler
*Attorney, Agent, or Firm*—Pearne, Gordon, McCoy & Granger

[57] ABSTRACT

A tube bending machine is provided which includes a rotatable bend die about which the tube is bent and a rotatable clamp die disposed outwardly of said bend die and movable to secure the tube between the clamp die and the bend die. A clamp die positioning system is provided which includes a drop-away clamp die holder supporting the clamp die, a hydraulic cylinder directly attached to the die clamp holder which advances and retracts the clamp die holder, and an electro-pneumatic control system which drives the cylinder at preselected pressures. The electro-hydraulic control system includes a hydraulic pump, a directional valve which varies the direction of flow of the hydraulic fluid to the cylinder, a proportional pressure reducing valve which varies the pressure of the hydraulic fluid, and a microprocessor controller which provides control signals to set the pressure to the preselected levels. The control also includes an encoder for providing the actual position of the clamp die to the controller which monitors a following error of the clamp die. The clamp die is moved from a retracted position to a position near a clamping position at a low pressure. If the clamp die encounters an obstacle, indicated by the following error increasing to a level above a predetermined level, it is automatically returned to the retracted position. Once the clamp die is near the clamping position, the pressure is increased to a required clamping pressure for the bend and the clamp die is moved to the clamping position.

21 Claims, 3 Drawing Sheets

12
14
22
16
52
60
42
56
18
54
48
62
58
50
20
66
80
44
64

16
60
52
58
42
56
54
48
62
50

14
50
24
16
12
82
OPERATOR INPUT
PRESSURE
CENTER LINE RADIUS
TUBE DIA. ETC.
76
CONTROLLER
78
23
SWING ARM ENCODER
80
POSITION FEEDBACK ENCODER
46
0-10VDC
110VDC
42
CLAMP DIE HOLDER
HYDRAULIC CYLINDER
PROPORTIONAL PRESSURE REDUCING VALVE
DIRECTION VALVE
PUMP
68
64
74
72
CLAMP DIE
MOTOR
70

LOW FORCE AUTO-OPEN TOOLING FOR TUBE BENDING MACHINE

BACKGROUND OF THE INVENTION

1. Field of the Invention

The present invention generally relates to a die positioning system for a tube bending machine, and more particularly to a die positioning system which moves the die into position at a low force prior to applying relatively high clamping force and automatically retracts the die if an obstacle is encountered.

2. Description of Related Art

Tube bending machines are well-known in the art. In one common type of machine, a tube is secured between a bend die and a clamp die which rotate together, drawing the lead portion of the tube therewith to bend it around the bend die. A pressure die engages an outside wall of the trailing portion of the tube to counter the reaction force of the tube during bending.

The purpose of the clamp die is to clamp the tube on a straight section of the bend die and rotate along with the bend die during the bending operation. The clamp die is typically mounted on a clamp die holder which is either mounted on a moving slide which moves in and out to close and open the tools, or mounted directly on a linkage mechanism which drops away into an arm cavity when in an open position to clear the tube after bending. The clamp die is normally positioned with a hydraulic cylinder which operates at a single pressure and a limit switch is typically used to indicate when the clamp die is fully closed. Typically, after the first bend is completed on a CNC tube bending machine using a carriage feed for the tube, the tools are opened before the bend arm can be returned to its home position for the next bend in the same tube. The arm, therefore, cannot be returned to its home position unless the tube clears the straight portion of the bend area. To do this the clamp die and holder must be out of the way before the carriage can move forward. In a non-drop-away clamp holder, either a double spindle arm is provided, where the inner spindle holds the bend die, so that the clamp die can be returned before the carriage moves forward, or the carriage and arm must be alternately be moved a distance equal to the slide opening distance until the arm returns without any interference with the tube. Another approach has been to use a drop-away clamp die holder mounted on the slide or on a toggle mechanism, which drops the clamp die below the centerline height of the bend die.

Each approach has a number of disadvantages. A double spindle weakens the arms, it still requires a toggle type slide which requires manual set-up for position of the tools, and pressure cannot be varied because of the toggle. The drop-away design mounted on the slide or on a drop-away linkage has the same problems. A further problem with all known designs is that the operator can be hurt if his or her hand is caught in a pinch point between the clamp die and the bend die.

SUMMARY OF THE INVENTION

The present invention provides a tube bending machine which overcomes at least some of the above noted problems of the related art. The tube bending machine includes a rotatable bend die about which the tube is bent and a clamp die rotated with the bend die and disposed outwardly of the bend die. The clamp die is movable to secure the tube between the clamp die and the bend die at a location adjacent a selected location of the tube for the bend. A clamp die positioning system is provided which includes a clamp die holder connected to the clamp die, a linear actuator connected to the clamp die holder, and a control system which automatically drives the linear actuator at variable pressure levels. Preferably, the clamp die is moved at a low pressure from a retracted position to a position near a required clamping position. If the clamp die encounters an obstacle, it is automatically returned to the retracted position. Once the clamp die is near the clamping position, the pressure is increased to a required clamping pressure for the bend and the clamp die is moved to the clamping position.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
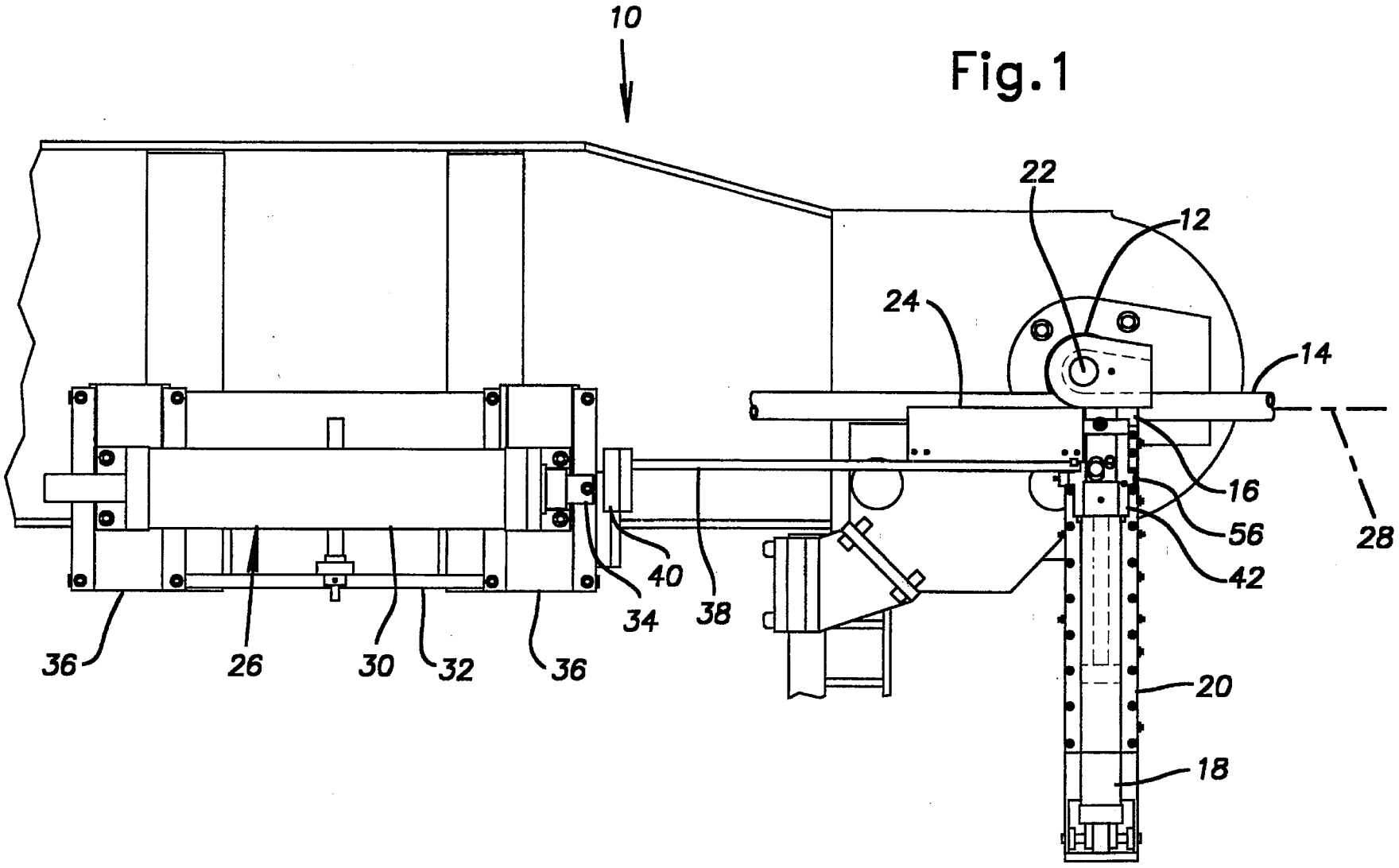
FIG. 1 is a top view of a tube bending machine according to the present invention.

FIG. 1 illustrates a tube bending machine 10 having a bend die 12 around which a tube 14 is formed. The tube 14 is held against the bend die 12 during a bending operation by a clamp die 16 which is advanced and retracted by a clamp die positioning assembly 18 before and after the bending operation respectively. The bend die 12 is attached to a bend or swing arm 20 which is mounted for rotational movement about one end of the tube bending machine 10. The swing arm 20 also houses the clamp die 16 and clamp die positioning assembly 18. The swing arm 20 is rotated about a vertical rotational axis 22 by a drive system (not shown) which includes an encoder 23 which electronically encodes the angular position of the swing arm 20 to provide the angular position of the bend die 12 at all times during the bend operation.

The tube 14 is also held against the bend die 12 by a pressure die 24 which counters the reaction force of the tube 14 during the bending operation. A pressure die assist boost system 26 is provided to horizontally move the pressure die 24 parallel to a longitudinal axis 28 of the tube 14. The forward movement of the pressure die 24 boosts the forward motion of the outside wall of the tube 14 during bending. The pressure die assist boost system 26 includes a high pressure hydraulic cylinder 30 having a plunger or pusher 32. The cylinder 30 is mounted such that the pusher 32 travels parallel to the longitudinal axis 28 of the tube 14. The cylinder 30 is mounted to a base assembly 34 by a pair of slides 36 oriented such that the cylinder 30 can horizontally travel in a transverse direction, that is, travel in a direction perpendicular to the direction of travel of the pusher 32. The pressure die 24 is attached to an end of an elongated rectangular plate or backing bar 38 which is attached at the other end to the pusher 32 by a gib assembly 40.

Figures 2, 2A:
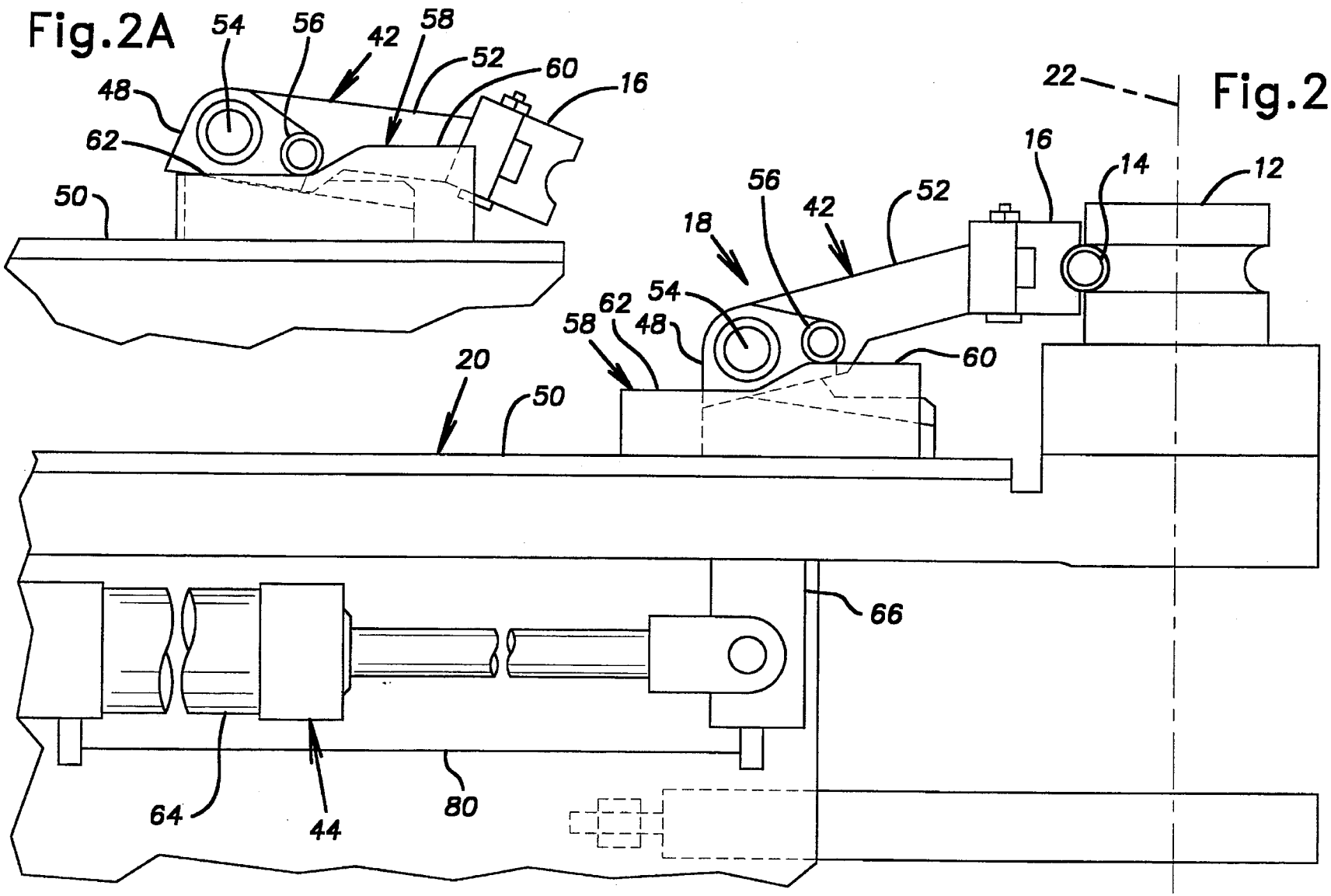
FIG. 2. is a side elevational view of a swing arm of the tube bending machine of FIG. 1 with a clamp die in a clamping position.
FIG. 2A. is a side elevational view of a portion of FIG. 2 but with the clamp die in an open position.

As best shown in FIG. 2, the clamp die positioning assembly 18 includes a drop-away clamp die holder 42, a linear actuator 44, and a programmable electro-hydraulic control system 46. The drop-away clamp die holder includes a base 48 which moves longitudinally along a top surface 50 of the swing arm 20 towards and away from the bend die 12. An arm member 52 is pivotally attached to a rear end of the base 48 such that the arm member 52 pivots about a horizontal axis 54. The forward end of the arm member 52 is adapted for carrying the clamp die 16. Extending from a side of the arm member 52 is a peg 56 which engages a camming surface 58 mounted at the top surface of the swing arm 20 at each side of the clamp die holder 42 to support the arm member 52. The camming surface 58 has a forward portion 60 which is positioned to support the clamp die 16 in a clamping position as shown in FIG. 2 and a rear portion 62 which is positioned to support the clamping die 16 in a lowered or retracted position as shown in FIG. 2A. It is noted that in the retracted position, the clamp die 16 and arm member 52 drop-away from the bend die 12 to a position below the tube 14 and below the centerline of the bend die 12 where they will not interfere with the tube upon rotation of the swing arm 20 or advancement of the tube 14. The forward and rear portions 60, 62 have a gradual transition such that the peg 56 easily slides between the two portions 60, 62 without interruption upon longitudinal movement of the clamp die holder 42.

The linear actuator 44 is mounted on the swing arm 20 and is positioned to longitudinally move the clamp die holder 42 and is directly attached to the clamp die holder 42. The linear actuator 44 of the illustrated embodiment is a hydraulic Cylinder 64 and is available from the Parker Corporation, part No. 2CBB2HLT14AC10. It is noted that other types of linear actuator 44 may be utilized such as, for example, an electric servo motor operating in torque mode. The hydraulic cylinder 64 is horizontally mounted between a rear end of the swing arm 20 and a bar 66 downwardly extending from the clamp die holder 42 and is substantially perpendicular to a vertical clamping plane formed at the interface between the clam die 16 and the bend die 12. Mounted in this manner, pressure from the hydraulic cylinder 64 is directly applied by the clamp die 16 on the tube 14 and is capable of producing a full stroke on the clamp die holder 42 to cover full center line radius capability of the tube bending machine 10.

Figures 3, 4, 5:
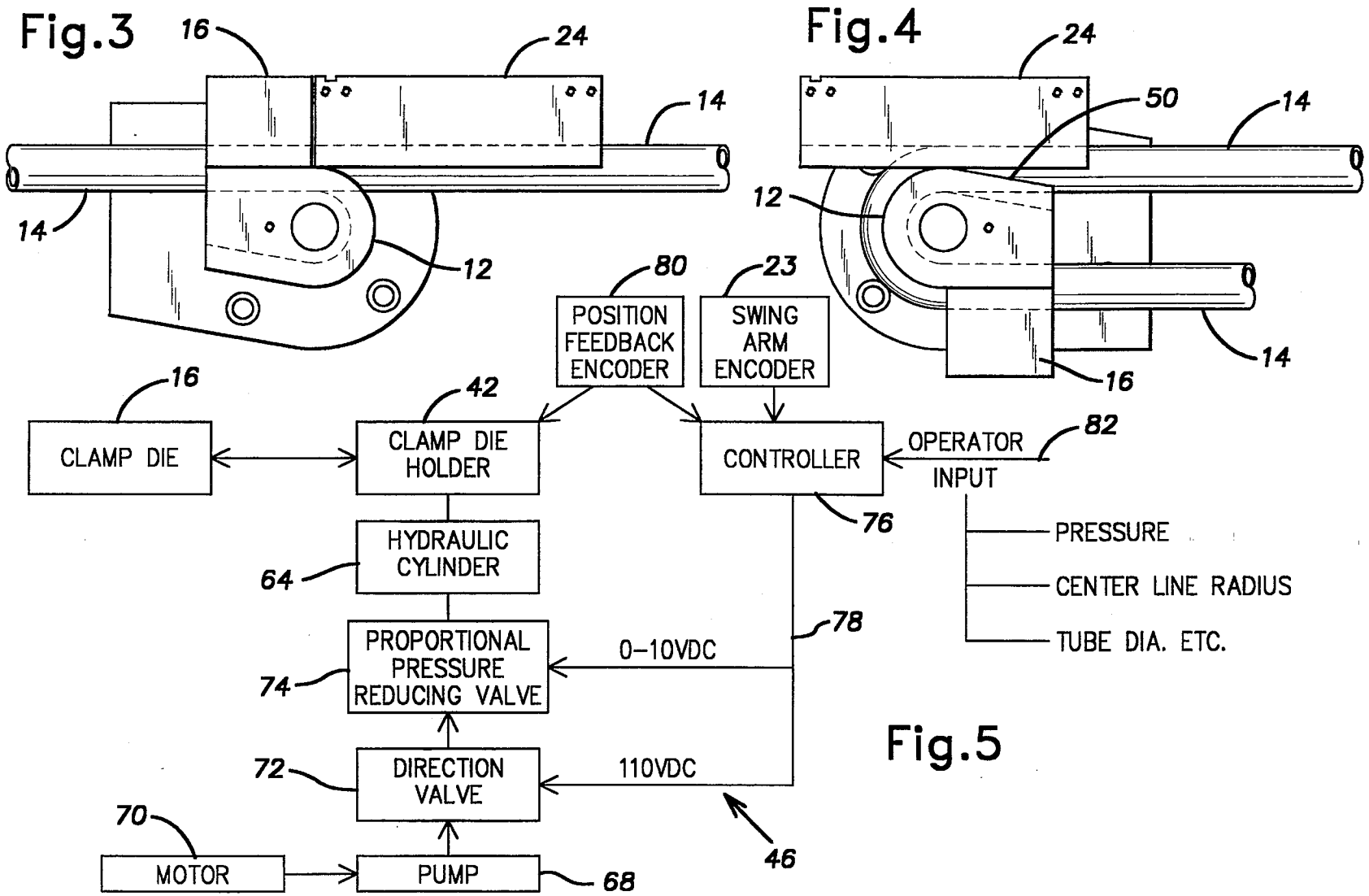
FIG. 3 is a top plan view illustrating the interrelationship between the bend die, the clamp die, and the pressure die at the initiation of a bending operation.
FIG. 4 is a top plan view illustrating the interrelationship between the bend die, the clamp die, and the pressure die similar to FIG. 3 except at the completion of a 180 degree bending operation.
FIG. 5 is a functional block diagram of an electrohydraulic control system of the clamp die positioning system.

The electro-hydraulic control system 46 is diagrammatically illustrated in FIG. 5. Hydraulic fluid is supplied from a variable displacement pressure compensated hydraulic pump 68 which is driven by an electric motor 70. The hydraulic pump 68 of the preferred embodiment is rated 16.5 GPM and 0–2000 psi, and the motor 70 of the preferred embodiment is rated at 7.5 hp and 1800 rpm. A directional valve 72 directs hydraulic fluid to and from the cylinder 64. The directional valve 72 of the preferred embodiment is available from the Parker Corporation, part no. D31VW4C1NJWF. The directional valve 72 is connected to the hydraulic pump 68 with a proportional pressure control valve 74. The proportional pressure reducing valve 74 of the preferred embodiment is available from the Parker Corporation, part No. T-30475. The proportional pressure reducing valve 74 operates with a command signal which ranges from 0 to 10 volts dc. The proportional pressure reducing valve 74 operates linearly except at the low end of the range where a command signal of 0 volts dc obtains a minimum pressure, such as 200 psi, and a command signal of 10 volts dc obtains full pressure. Preferably the valve 74 is capable of controlling pressures up to about 3,000 psi.

A microprocessor based controller 76 supplies control signals 78 to both the directional valve 72 and the proportional pressure control valve 74. The pressure of the hydraulic cylinder 64 is variable and can be preprogrammed into the controller 76. Software allows the operator to preprogram the controller 76 by imputing data 82 such as desired moving and clamping pressures, centerline radius of the bend, the diameter of the tube 14 to be bent, any desired locations for the clamp die 16, or any other desired data. Preferably, the pressure levels are input as a percentage of the maximum system pressure, however, they can alternatively be input in units of psi. The controller 76 then converts the percentage into the proper command signal. For example, if a 100% pressure level is input, the controller 76 sends a 10 volts dc signal to the proportional pressure reducing valve 74. The controller 76 can be in communication with the swing arm encoder 23 so that the controller 76 receives the angular position of the bend die 12-during the bending operation and automatically triggers movement of the clamp die 16. Alternatively, the controller 76 is triggered manually to initiate movement of the clamp die 16. A position sensor 80 is provided which is in electrical communication with the controller 76 to provide data representative of the position of the clamp die 16. The sensor 80 is preferably an encoder such as, for example, a string encoder, a rack and pinion encoder, or any other suitable type of encoder. The position sensor of the illustrated embodiment is located between the rear end of the swing arm 20 and the bar 66 of the clamp die holder 42.

As shown in FIG. 3, at the beginning of a bend operation the tube 14 is clamped between the bend die 12 and the clamp die 16 which is aligned with the clamp portion 46 of the bend die groove 38. The clamp die 16 is moved into the clamping position by the hydraulic cylinder 64. Preferably, the clamp die 16 is advanced at the minimum pressure required to move the clamp die holder 42 which can be provided by the control system 46. The controller 76 receives the location of the clamp die 16 from the encoder 80 and advances the clamp die to a position just short of the required clamping position, preferably about 0.125 inches, by comparing the actual location data from the encoder 80 with the calculated required clamping position. The required clamping position has been calculated by the controller 76 from the input data 82. While the clamp die 16 is advanced at a low pressure, the controller 76 monitors the following error, that is the difference between the actual position and a predicted position which is calculated based on time and speed. If the following error goes above a predetermined level, the controller 76 sends command signals 78 to automatically return the clamp die 16 to the open or retracted position (shown in FIG. 2A). The high following error indicates that an obstruction may have been contacted. If the command to reverse fails, or the clamp die 16 moves when it is not commanded to, power to the pump motor 70 is shut down. Once the clamp die 16 is near the required clamping position, the controller 76 sends a command signal 78 to the proportional pressure reducing valve 74 to increase the pressure to the required clamping pressure for bending the tube and the clamp die 16 is moved into the required clamping position (as shown in FIG. 2).

The pressure die 24 is in abutting relation to the end of the clamp die 16 such that the leading end of the pressure die 24 is positioned at the transition of a bend portion of the bend die 12. The bend die 12 and the clamp die 16 are rotated by the swing arm 20 at a constant rate of speed such as, for example, 5 to 50 rpm. Simultaneously, the pressure die 24 is advanced by the pressure die assist boost system 26 in a linear direction to maintain bending pressure on the tube 14 as the bend die 12 is rotated. The action Of the pressure die 24 minimizes stretching or thinning of the outer wall of the tube 14. As shown in FIG. 4, after rotating the bend die 12 about 180 degrees, the pressure die 24 is located adjacent the end portion of the bend die 12. At the completion of the bending operation, the controller 76 sends command signals 78 to the valves 72, 74 to move the clamp die 16 to the retracted position (as shown in FIG. 2A). With the clamp die 16 in the retracted position, the tube can be fed forward without a restriction from the clamp die 16.

Although particular embodiments of the invention have been described in detail, it will be understood that the invention is not limited correspondingly in scope, but includes all changes and modifications coming within the spirit and terms of the claims appended hereto.

What is claimed is:

1. A tube bending machine for placing at least one bend in a tube, said tube bending machine comprising:

a rotatable bend die about which the tube is bent;

a rotatable clamp die disposed outwardly of said bend die and movable to secure the tube between the clamp die and the bend die at a location adjacent a selected location of the tube for the bend; and a clamp die positioning system including a drop-away clamp die holder selectively positioning the clamp die in a clamping position and a lowered position below a centerline of said bend die, a linear actuator connected to the clamp die holder which moves in a direction perpendicular to a generally vertical clamping plane formed by an interface of said clamp die and said bend die, and a control system for automatically driving the linear actuator at variable pressure levels.

2. The tube bending machine according to claim 1, wherein said linear actuator is a hydraulic cylinder operatively connected to said clamp die holder, and said control system is an electro-hydraulic control system including a hydraulic pump for providing hydraulic fluid to said cylinder, a directional valve for varying direction of flow of the hydraulic fluid to the cylinder, a proportional pressure reducing valve for varying the pressure of the hydraulic fluid connecting said cylinder and said directional valve, and a controller in electrical communication with the directional valve and the proportional pressure reducing valve for providing control signals to set the pressure of the hydraulic fluid to preselected levels.

3. The tube bending machine according to claim 1, wherein said clamp die holder includes a horizontally movable base and an arm pivotally attached to said base, said arm supporting said clamp die and said linear actuator attached to said base, and a camming surface engageable by said arm, said camming surface having a horizontal forward portion to position said clamp die in the clamping position and a horizontal rear portion to position said clamp die in the lowered position.

4. The tube bending machine according to claim 3, wherein said forward portion and said rear portion Of said camming surface are vertically offset and have a gradual transition therebetween.

5. The tube bending machine according to claim 1, wherein data pre-programmed into said controller includes at least a clamping pressure and a moving pressure, said moving pressure being lower than said clamping pressure.

6. The tube bending machine according to claim 3, wherein said controller is adapted for calculating a following error and automatically returning said clamp die to an open position if said following error is above a predetermined level.

7. The tube bending machine according to claim 2, wherein said controller is adapted for automatically shutting off power to said hydraulic pump if said clamp die fails to move in response to a signal from said controller.

8. The tube bending machine according to claim 6, wherein said sensornis a string encoder.

9. The tube bending machine according to claim 6, wherein said controller is adapted for calculating a following error and automatically returning said clamp die to an open position if said following error is above a predetermined level.

10. The tube bending machine according to claim 3, wherein said linear actuator is directly connected to said base.

11. The tube bending machine according to claim 10, wherein each of said pressure settings is input as a percentage of maximum pressure of said electro-hydraulic control system.

12. A method for bending a tube comprising the steps of:

(a) loading the tube adjacent a first die;

(b) advancing a second die towards the first die with a first force at a first speed;

(c) stopping the second die short of a clamping position after the step of advancing the second die toward the first die at the first speed;

(d) advancing the second die to a clamping position at a second Speed, wherein said second speed is greater than said first speed;

(c) clamping the tube between the first die and the second die with a second force, wherein said second force is higher than said first force;

(f) forming a bend in the tube;

(g) retracting said second die from said first die after the step of forming a bend in the tube.

13. The method according to claim 12, wherein said first die is a bend die and said second die is a clamp die.

14. The method according to claim 12, wherein said first force is generally equal to a minimum force required for advancing said second die.

15. The method according to claim 12, wherein said second die is stopped short of said clamping position by a distance of about 0.125 inches.

16. The method according to claim 12, further comprising the step of monitoring a following error of said second die.

17. The method according to claim 12, further comprising the step of shutting off power if said second die fails to advance or retract.

18. The method according to claim 17, further comprising the step of automatically retracting said second die when said following error is greater than a predetermined level.

19. A tube bending machine for placing at least one bend in a tube, said tube bending machine comprising:

a rotatable bend die about which the tube is bent;

a rotatable clamp die disposed outwardly of said bend die and movable to secure the tube between the clamp die and the bend die at a location adjacent a selected location of the tube for the bend; and a clamp die positioning system including a drop-away clamp die holder selectively supporting the clamp die in a clamping position and a lowered position below a centerline of said bend die, a linear actuator directly connected to the clamp die holder, and a control system for automatically driving the linear actuator, wherein Said linear actuator moves in a direction substantially perpendicular to a generally vertical clamping plane formed by an interface of said clamp die and said bend die.

20. The method according to claim 19, wherein said clamp die holder includes a horizontally movable base and an arm pivotally attached to said base, said arm supporting said clamp die and said linear actuator attached to said base, and a camming surface engageable by said arm, said camming surface having a horizontal forward portion to position said clamp die in the clamping position and a horizontal rear portion to position said clamp die in the lowered position.

21. The tube bending machine according to claim 19, wherein said linear actuator is a substantially horizontal pneumatic cylinder.

* * * * *

UNITED STATES PATENT AND TRADEMARK OFFICE

CERTIFICATE OF CORRECTION

PATENT NO. : 5,617,753

DATED : April 8, 1997

INVENTOR(S) : Thomas W. Glissman and Ajay K. Bhandari

It is certified that error appears in the above-indentified patent and that said Letters Patent is hereby corrected as shown below:

On the first page, under "U.S. Patent Documents," please insert the following:

| | | |
|---|---|---|
| 3,545,247 | 12/1970 | Fazzani |
| 3,999,477 | 12/1976 | Good et al. |
| 4,760,726 | 8/1988 | Traub |
| 5,343,725 | 9/1994 | Sabine |
| 4,765,168 | 8/1988 | Stange et al. |
| 2,456,675 | 12/1948 | Chaille |
| 4,502,307 | 3/1985 | Grunewald |
| 3,874,205 | 4/1975 | Roch et al. |

Column 3, line 38, please delete "Cylinder" and insert therefor --cylinder--.

Column 3, line 40, please delete "actuator" and insert therefor --actuators--.

Column 4, line 23, please delete "12-during" and insert therefor --12 during--.

Column 5, line 7, please delete "Of" and insert therefor --of--.

Column 5, line 61, claim 4, please delete "Of" and insert therefor --of--.

UNITED STATES PATENT AND TRADEMARK OFFICE

CERTIFICATE OF CORRECTION

PATENT NO. : 5,617,753

DATED : April 8, 1997

INVENTOR(S) : Thomas W. Glissman and Ajay K. Bhandari

It is certified that error appears in the above-indentified patent and that said Letters Patent is hereby corrected as shown below:

Column 6, lines 1-5, please delete claim 6 in its entirety and insert the proper claim 6 as follows:

--6. The tube bending machine according to claim 2, wherein said control system further includes a sensor for detecting a position of the clamp die in electrical communication with said controller.--.

Column 6, line 11, claim 8, please delete "sensornis" and insert therefor --sensor is--.

Column 6, line 20, claim 11, please delete "10" and insert therefor --5--.

Column 6, line 32, claim 12, please delete the first occurrence of "Speed" and insert therefor --speed--.

Column 6, line 34, claim 12, please delete "(c)" and insert therefor --(e)--.

Column 6, line 36, claim 12, please delete "higher" and insert therefor --greater--.

UNITED STATES PATENT AND TRADEMARK OFFICE

CERTIFICATE OF CORRECTION

PATENT NO. : 5,617,753

DATED : April 8, 1997

INVENTOR(S) : Thomas W. Glissman and Ajay K. Bhandari

It is certified that error appears in the above-indentified patent and that said Letters Patent is hereby corrected as shown below:

Column 6, line 54, claim 18, please delete "17" and insert therefor --16--.

Column 7, line 4, claim 19, please delete "Said" and insert therefor --said--.

Signed and Sealed this

Eighteenth Day of November 1997

*Attest:*

Bruce Lehman

BRUCE LEHMAN

*Attesting Officer*

*Commissioner of Patents and Trademarks*